US010158160B2

(12) United States Patent
McMichael et al.

(10) Patent No.: US 10,158,160 B2
(45) Date of Patent: Dec. 18, 2018

(54) DEVICES AND METHOD FOR METAMATERIALS

(71) Applicant: The MITRE Corporation, McLean, VA (US)

(72) Inventors: Ian T. McMichael, Stow, MA (US); Jamie R. Hood, Durham, NC (US); Mohamed Wajih Elsallal, Acton, MA (US)

(73) Assignee: THE MITRE CORPORATION, McLean, VA (US)

( * ) Notice: Subject to any disclaimer, the term of this patent is extended or adjusted under 35 U.S.C. 154(b) by 26 days.

(21) Appl. No.: 15/262,727

(22) Filed: Sep. 12, 2016

(65) Prior Publication Data

US 2018/0076503 A1 Mar. 15, 2018

(51) Int. Cl.
*H01P 7/10* (2006.01)

(52) U.S. Cl.
CPC ..... *H01P 7/10* (2013.01); *H01P 7/105* (2013.01)

(58) Field of Classification Search
CPC ..... H01P 7/10
USPC ..... 333/219.1
See application file for complete search history.

(56) References Cited

U.S. PATENT DOCUMENTS 7,646,524 B2 1/2010 Tonucci
2012/0193997 A1* 8/2012 Hong ..... H01P 7/08 307/104
2013/0207737 A1 8/2013 Weldon et al.
2014/0111400 A1 4/2014 Latrach et al.
2017/0062692 A1* 3/2017 Dial ..... H01L 39/00

OTHER PUBLICATIONS

Benosman et al., Design and Simulation of Double "S" Shaped Metamaterial, IJCSI International Journal of Computer Science Issues, vol. 9, Issue 2, No. 1, Mar. 2012, pp. 534-237.
Chen et al. Negative refraction of a combined double S-shaped metamaterial, Applied Physics Letters 86, 151909 (2005).
Chen et al., Magnetic Properties of S-Shaped Split-Ring Resonators, Progress in Electromagnetics Research, PIER 51, 231-247, 2005.
Cheng et al., Negative Refraction and Cross Polarization Effects in Metamaterial Realized with Bianisotropic S—Ring Resonator, Physical Review B, vol. 76, No. 2, 024402, 2007.
Ding et al., Characteristic of Electromagnetic Wave Propagation in Biaxially Anisotropic Left-Handed Materials, Progress in Electromagnetics Research, PIER 70, 37-52, 2007.
Herrojo et al., Spectral signature barcodes based on S-shaped Split Ring Resonators (S-SRRs), EPJ Appl. Metamat. 2016, 3, 1, pp. 1-6.
Lustrac et al. Design and Characterization of Metamaterials for Optical and Radio Communications, Metamaterial, Dr. Xun- Ya Jiang (Ed.), ISBN: 978-953-51/0591-6, InTech, Chapter 11, pp. 269-302.

(Continued)

*Primary Examiner* — Stephen E Jones
*Assistant Examiner* — Scott S Outten
(74) *Attorney, Agent, or Firm* — Pearl Cohen Zedek Latzer Baratz LLP

(57) ABSTRACT

A metamaterial for receiving electromagnetic waves having any polarization is provided. The metamaterial allows for receipt and/or propagation of electromagnetic waves at a resonant frequency of the metamaterial.

10 Claims, 4 Drawing Sheets

(56) References Cited

OTHER PUBLICATIONS

Sajuyigbe, Adesoji, Electromagnetic Metamaterials for Antenna, Dissertation submitted in partial fullment of the requirements for the degree of Doctor of Philosophy in the Department of Electrical and Computer Engineering in the Graduate School of Duke University 2010, pp. 1-145.

Wang et al., Experimental Validation of Negative Refraction of Metamaterial Composed of Single Side Paired S—Ring Resonators, Applied Physics Letters, vol. 90, No. 25, 254103, 2007.

* cited by examiner

DEVICES AND METHOD FOR METAMATERIALS

The invention relates generally to metamaterials. In particular, the invention relates generally to metamaterials having a negative index of refraction and capable of receiving incident waves having any polarization.

BACKGROUND

Currently, metamaterials can be formed with repeating and periodic structures. Metamaterials can be materially engineered to have desired properties (e.g., a desired index of refraction). Metamaterials can have properties that depend on physical placement of the elements in the metamaterial. There are currently many types of metamaterials, including electric metamaterials and magnetic materials.

Current metamaterials can have a negative index of refraction at its resonant frequency. These current metamaterials can be limiting in that in order for incident electromagnetic waves to propagate in the metamaterial, the incident electromagnetic wave typically has to impinge upon the metamaterial with a particular polarization. For example, an electric field component and a magnetic field component of the incident electromagnetic wave may be required to align with certain components in the metamaterial in a particular direction in order for the incident wave to propagate through the metamaterial with a negative index of refraction.

Therefore, it can be desirable to have a metamaterial with a negative index of refraction that can propagate an incident electromagnetic wave having any polarization direction.

SUMMARY OF EMBODIMENTS OF THE INVENTION

One advantage of the invention is that it can allow propagation of incident electromagnetic waves having any polarization.

In one aspect, the invention includes a metamaterial. The metamaterial includes a first s-shaped split ring resonator element. The metamaterial also includes a second s-shaped split ring resonator element intersecting and positioned orthogonal to the first s-shaped resonator element, such that an electromagnetic wave having any orientation can resonate within the metamaterial.

In some embodiments, the first s-shaped split ring resonator element and the second intersecting split ring resonator element are manufactured by 3-D printing. In some embodiments, the first s-shaped split ring resonator element and the second s-shaped split ring resonator element are substantially equal in size, and wherein the size depends on a desired resonant frequency of the metamaterial. In some embodiments, the first s-shaped split ring resonator and the second s-shaped split ring resonator are a first unit cell.

In some embodiments, the metamaterial includes a second unit cell. The second unit cell can be positioned adjacent to the first unit cell. The second unit cell can include a third s-shaped split ring resonator element, and a fourth s-shaped split ring resonator element, the fourth s-shaped split ring resonator positioned orthogonal to the third s-shaped resonator element.

In some embodiments, the first s-shaped split ring resonator and the second s-shaped split ring resonator are a conductive material within a range of $1*10^6$-$60*10^6$ S/m. In some embodiments, the first s-shaped split ring resonator and the second s-shaped split ring resonator are metal or conductive epoxy.

In another aspect, the invention involves a method for receiving an electromagnetic wave having any polarization. The method involves positioning a plurality of unit cells in an adjacent configuration to create a metamaterial, each unit cell comprising a first s-shaped split ring resonator element orthogonal to a second s-shaped split ring resonator element, such that the metamaterial has a negative index of refraction.

In some embodiments, the plurality of unit cells are positioned in an adjacent configuration via 3-D printing. In some embodiments, the metamaterial has a resonant frequency that depends on the length, width and height of a unit cell.

BRIEF DESCRIPTION OF THE DRAWINGS

The foregoing and other objects, features, and advantages of the present invention, as well as the invention itself, will be more fully understood from the following description of various embodiments, when read together with the accompanying drawings.

DETAILED DESCRIPTION OF EMBODIMENTS OF THE INVENTION

Figure 1A:
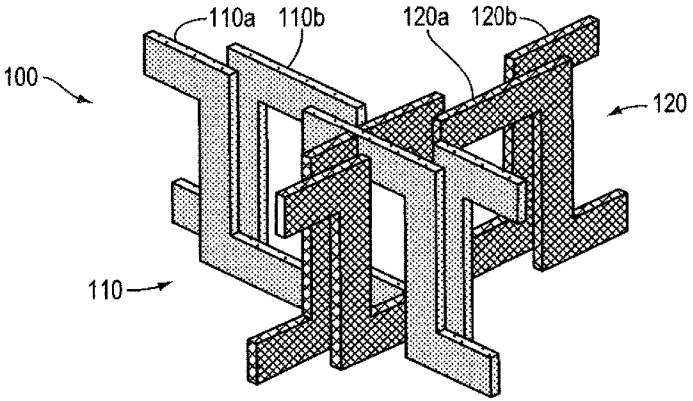
FIG. 1A is a three dimensional perspective view of a unit cell of a metamaterial, according to an illustrative embodiment of the invention.
Figure 1C:
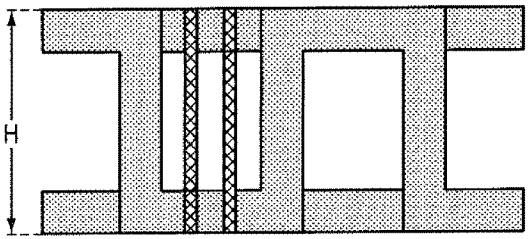
FIG. 1C is a two dimensional side view of the unit cell of FIG. 1A, according to an illustrative embodiment of the invention.
Figure 1B:
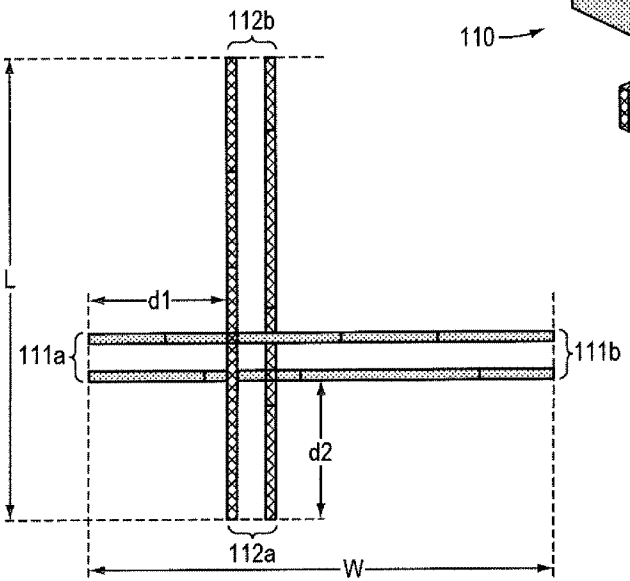
FIG. 1B is a two dimensional top down view of the unit cell of FIG. 1A, according to an illustrative embodiment of the invention.

FIG. 1A is a three dimensional perspective view of a unit cell 100 of a metamaterial, according to an illustrative embodiment of the invention. FIG. 1B is a two dimensional top down view of the unit cell 100 of FIG. 1A, according to an illustrative embodiment of the invention. FIG. 1C is a two dimensional side view of the unit cell 100 of FIG. 1A, according to an illustrative embodiment of the invention.

The unit cell 100 includes a first S-shaped split ring resonator 110 and a second S-shaped split ring resonator 120. The first S-shaped split ring resonator 110 has a length (L) and a height (H). The second S-shaped split ring resonator 120 has a width (W) and the height (H). The width (W) and the length (L) are equal (or substantially equal). The unit cell 100 has a length, width, and height that are the length (L), width (W) and height (H) of the first S-shaped split ring resonator 110 and the second S-shaped split ring resonator 120, respectively.

The width (W) can depend on an expected frequency of incident waves (e.g., an operation frequency). In some embodiments, the width (W) is approximately 6.75 mm to exhibit a negative index of refraction at approximately 10 GHz. In various embodiments, the width (W) is scalable to operate at various frequencies. For example, the width (W) is decreased proportional to an increase in operation frequency. In another example, the width (W) is increased proportional to a decrease in operation frequency.

The length (L) can depend on an expected frequency of incident waves (e.g., an operation frequency). In some embodiments, the length (L) is approximately 6.75 mm to exhibit a negative index of refraction at approximately 10 GHz. In various embodiments, the length (L) is scalable to operate at various frequencies. For example, the length (L) is decreased proportional to an increase in operation frequency. In another example, the length (L) is increased proportional to a decrease in operation frequency.

The height (H) can depend on an expected frequency of incident waves (e.g., an operation frequency). In some embodiments, the height (H) is approximately 6.3 mm to exhibit a negative index of refraction at approximately 10 GHz. In various embodiments, the height (H) is scalable to operate at various frequencies. For example, the height (H) is decreased proportional to an increase in operation frequency. In another example, the 1 height (H) is increased proportional to a decrease in operation frequency.

The first S-shaped split ring resonator 110 and a second S-shaped split ring resonator 120 each have a first end 112*a*, and 111*a*, respectively, and a second end 112*b* and 111*b*, respectively. The first S-shaped split ring resonator 110 and a second S-shaped split ring resonator 120 are positioned in an orthogonal configuration. The first S-shaped split ring resonator 110 can be positioned orthogonal to the second S-shaped split ring resonator 120 at a distance d1 from the first end 111*a* of the second S-shaped split ring resonator. The second S-shaped split ring resonator 120 can be positioned orthogonal to the first S-shaped split ring resonator 110 at a distance d2 from the first end 112*a* of the first S-shaped split ring resonator 110.

In some embodiments, the distance d1 is 3.375 mm to exhibit a negative index of refraction at approximately 10 GHz. In some embodiments, the distance d2 is 3.375 mm to exhibit a negative index of refraction at approximately 10 GHz.

The first S-shaped split ring resonator 110 and the second S-shaped split ring resonator 120 can be positioned such that they are intersecting at a connection point. The intersection can be achieved via 3D printing. For example, the 3D printing can be performed with a Developer's Kit as produced by Voxel8. As is apparent to one of ordinary skill in the art, the 3D printing can be performed by any 3D printer as is known in the art. In this manner, when the first S-shaped split ring resonator 110 and the second S-shaped split ring resonator 120 are 3D printed into their respective positions, for example as described above, losses can be minimized at the connection point.

The first S-shaped split ring resonator 110 includes two resonator elements 110*a* and 110*b*. The second S-shaped split ring resonator 120 includes two resonator elements 120*a* and 120*b*. In various embodiments, the first S-shaped split ring resonator elements 110*a* and 110*b* and/or the second S-shaped split ring resonator elements 120*a* and 120*b* are a highly conductive material. In various embodiments, the first S-shaped split ring resonator elements 110*a* and 110*b* and/or the second S-shaped split ring resonator elements 120*a* and 120*b* conductive material within a range of $1*10^6$-$60*10^6$ S/m.

In various embodiments, the first S-shaped split ring resonator elements 110*a* and 110*b* and/or the second S-shaped split ring resonator elements 120*a* and 120*b* are 3D printed conductive silver ink or paste. In various embodiments, the first S-shaped split ring resonator elements 110*a* and 110*b* and/or the second S-shaped split ring resonator elements 120*a* and 120*b* are positioned within a dielectric material.

Figure 2:
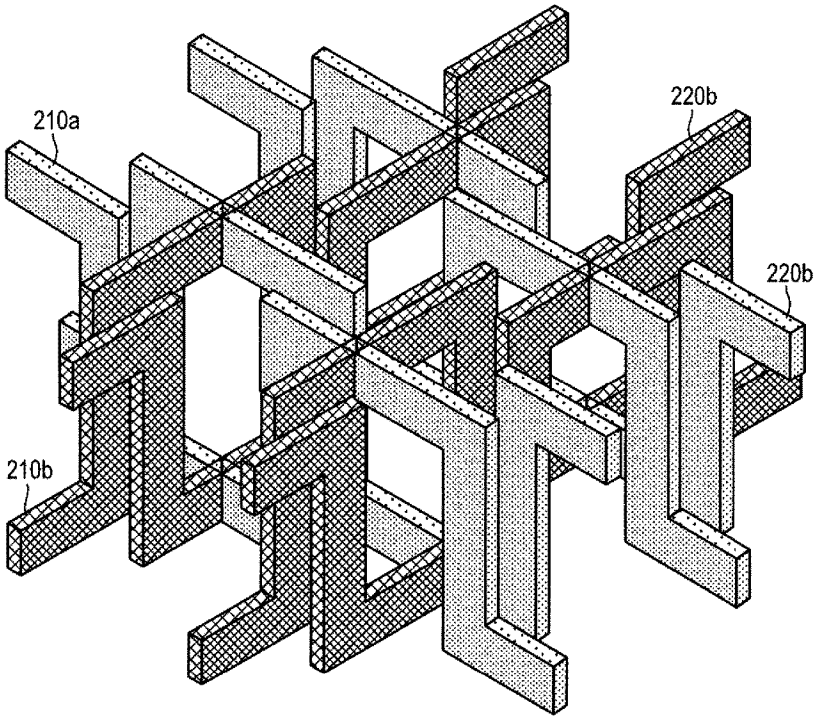
FIG. 2 is a three dimensional perspective view of a metamaterial having two unit cells, according to an illustrative embodiments of the invention.

FIG. 2 is a three dimensional perspective view of a metamaterial 200 having two unit cells (e.g., unit cell 100 as described above in FIG. 1A), according to an illustrative embodiments of the invention. The metamaterial 200 includes a first unit cell and a second unit cell. The first unit cell includes a first unit cell first S-shaped split ring resonator 210*a*, and a first unit cell second S-shaped split ring resonator 210*b*. The second unit cell includes a second unit cell first S-shaped split ring resonator 220*a*, and a second unit cell second S-shaped split ring resonator 220*b*. In various embodiments, more than two unit cells can be used to create a bulk metamaterial, as is described in further detail below.

Figure 3B:
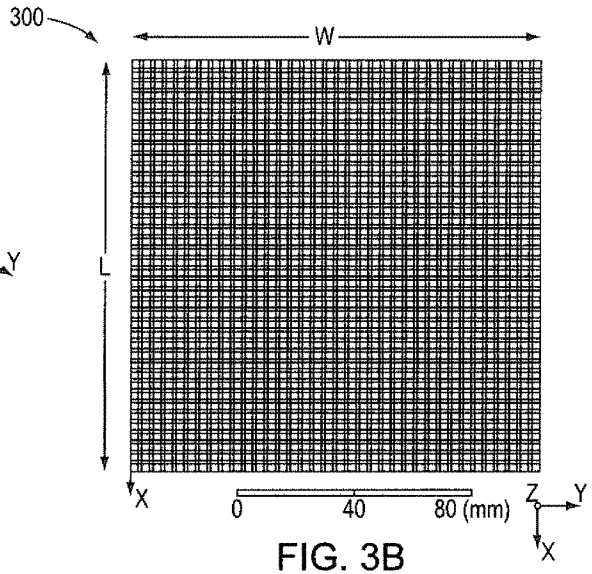
FIG. 3B is a two dimensional top down view of the metamaterial of FIG. 3A, according to an illustrative embodiment of the invention.
Figure 3A:
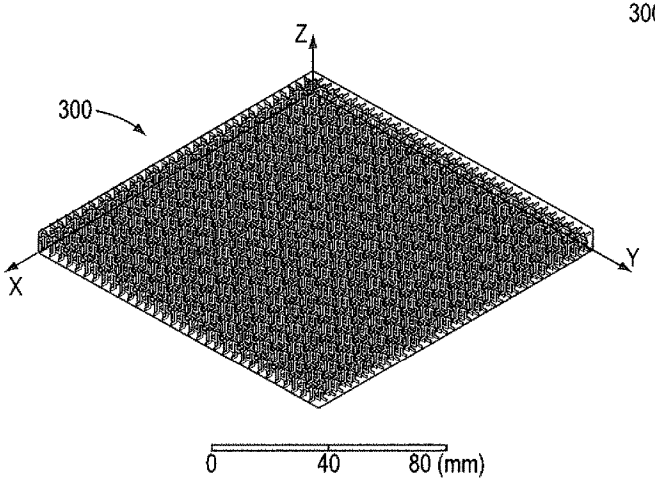
FIG. 3A is a three dimensional perspective view of a metamaterial, according to an illustrative embodiment of the invention.
Figure 3C:
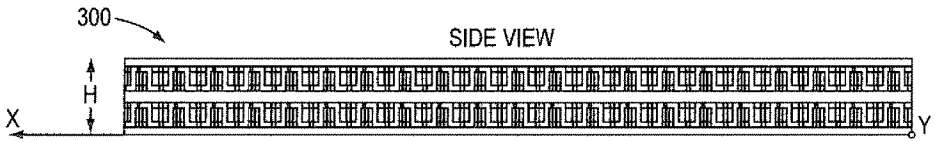
FIG. 3C is a two dimensional side view of the metamaterial of FIG. 3A, according to an illustrative embodiment of the invention.

FIG. 3A is a three dimensional perspective view of a metamaterial 300, according to an illustrative embodiment of the invention. FIG. 3B is a two dimensional top down view of the metamaterial 200 of FIG. 3A, according to an illustrative embodiment of the invention. FIG. 3C is a two dimensional side view of the metamaterial 300 of FIG. 3A, according to an illustrative embodiment of the invention. The metamaterial 300 is comprised of multiple unit cells (e.g., the unit cell 100 as described above in FIGS. 1A-1C). The metamaterial 300 shown has a width (W), length (L) and height (H). The width (W), length (L) and height (H) can depend on a resonant frequency of electromagnetic waves the metamaterial receives. A bulk metamaterial may consist of many unit cells so that the bulk material is multiple wavelengths in width (W) and length (L). For example, to receive incident plane waves at ~10 gigahertz, the width (W), length (L) and height (H) of the metamaterial 300 can be ~135 millimeters, 135 millimeters, and 12.6 millimeters, respectively.

During operation, the metamaterial 300 has electromagnetic waves impinged upon its surface. When the electromagnetic waves are at the resonant frequency of the metamaterial (or substantially having the resonant frequency) impinge upon the surface of the metamaterial 300, at least a portion of the electromagnetic waves is refracted into the metamaterial 300, irrespective of the polarization of the impinging electromagnetic waves. Therefore, regardless of the polarization of the impinging electromagnetic waves, the electromagnetic waves can propagate within the metamaterial 300. The portion of the electromagnetic waves that propagates into the metamaterial 300 is refracted with a negative index of refraction.

In some embodiments, the metamaterial 300 is a highly conductive metal. In some embodiments, the metamaterial is 3D printed conductive silver ink or paste. In some embodiments, the metamaterial 300 is 3D printed.

Figure 4A:
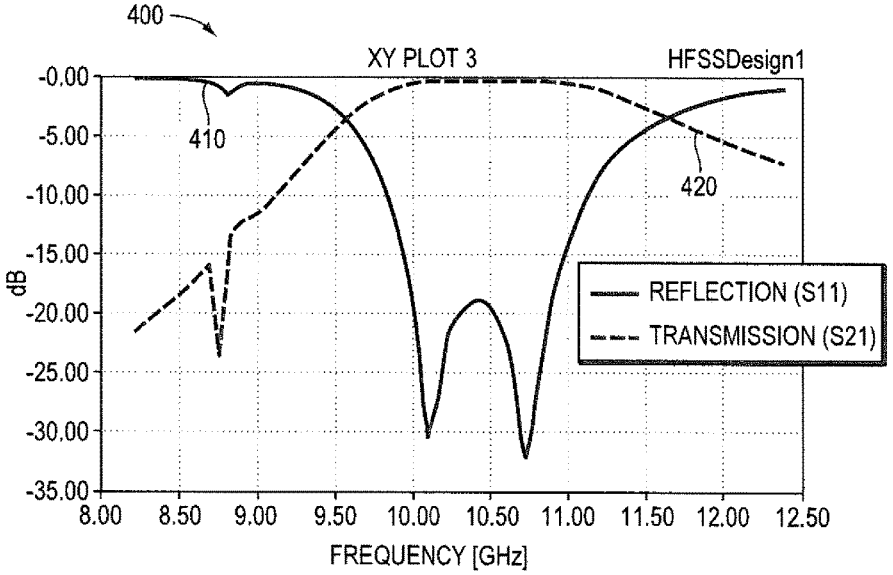
FIG. 4A is a graph showing exemplary reflection and transmission for a metamaterial, according to an illustrative embodiment of the invention.
Figure 4B:
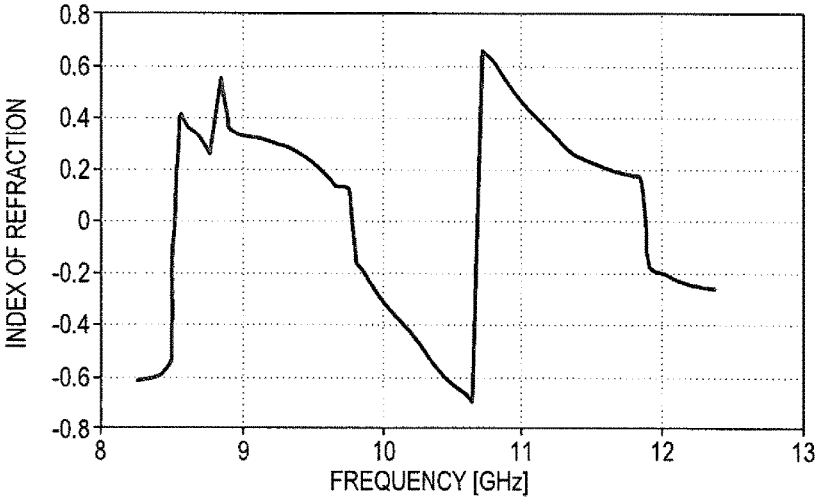
FIG. 4B is a graph shown an exemplary index of refraction for the metamaterial of FIG. 4A, according to an illustrative embodiment of the invention.

FIG. 4A is a graph 400 showing exemplary reflection and transmission for a metamaterial (e.g., metamaterial 300), according to an illustrative embodiment of the invention. FIG. 4B is a graph 410 shown an exemplary index of refraction for the metamaterial of FIG. 4A, according to an illustrative embodiment of the invention. As shown in FIGS.

4A and 4B when viewed together, for the metamaterial, at a frequency of approximately 10 GHZ, the wave can be transmitted and the index of refraction is negative.

Comprise, include, and/or plural forms of each are open ended and include the listed parts and can include additional parts that are not listed. And/or is open ended and includes one or more of the listed parts and combinations of the listed parts.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

What is claimed is:

1. A metamaterial comprising:

a first s-shaped split ring resonator element; and a second s-shaped split ring resonator element positioned orthogonal to the first s-shaped split ring resonator element and intersecting the first s-shaped split ring resonator along its width at a location other than a half-way point of the width, such that an electromagnetic wave having any orientation can resonate within the metamaterial, the metamaterial having a negative index of refraction, and wherein the metamaterial is used to guide the electromagnetic wave.

2. The metamaterial of claim 1, wherein the first s-shaped split ring resonator and the second s-shaped split ring resonator are a first unit cell.

3. The metamaterial of claim 2 further comprising:

a second unit cell, the second unit cell positioned adjacent to the first unit cell, the second unit cell comprising: a third s-shaped split ring resonator element, and a fourth s-shaped split ring resonator element, the fourth s-shaped split ring resonator positioned orthogonal to the third s-shaped resonator element.

4. The metamaterial of claim 1 wherein the first s-shaped split ring resonator element and the second intersecting split ring resonator element are manufactured by 3-D printing.

5. The metamaterial of claim 1 wherein the first s-shaped split ring resonator element and the second s-shaped split ring resonator element are substantially equal in size, and wherein the size depends on a desired resonant frequency of the metamaterial.

6. The metamaterial of claim 1, wherein the first s-shaped split ring resonator and the second s-shaped split ring resonator are a conductive material within a range of $1*10^6$-$60*10^6$ S/m.

7. The metamaterial of claim 1, wherein the first s-shaped split ring resonator and the second s-shaped split ring resonator are metal or conductive epoxy.

8. A method for receiving an electromagnetic wave having any polarization, the method comprising:

positioning a plurality of unit cells in an adjacent configuration to create a metamaterial, each unit cell comprising a first s-shaped split ring resonator element orthogonal to a second s-shaped split ring resonator element and intersecting the first s-shaped split ring resonator along its width at a location other than a half-way point of the width, such that the metamaterial has a negative index of refraction, and wherein the metamaterial is used to guide the electromagnetic wave.

9. The method of claim 8 wherein the plurality of unit cells are positioned in an adjacent configuration via 3-D printing.

10. The method of claim 9 wherein the metamaterial has a resonant frequency that depends on the length, width and height of a unit cell.

* * * * *